US005459303A

United States Patent [19]

Kwon

[11] Patent Number: 5,459,303

[45] Date of Patent: Oct. 17, 1995

[54] METHOD OF PREVENTING NO-LOAD OPERATION OF MICROWAVE OVEN

[75] Inventor: Chul H. Kwon, Kyungsangnam-Do, Rep. of Korea

[73] Assignee: Goldstar Co., Ltd., Rep. of Korea

[21] Appl. No.: 366,326

[22] Filed: Dec. 29, 1994

[30] Foreign Application Priority Data

Mar. 2, 1994 [KR] Rep. of Korea ..... 4013/1994

[51] Int. Cl.[6] ..... H05B 6/68

[52] U.S. Cl. ..... 219/705; 219/707; 219/710

[58] Field of Search ..... 219/705, 707, 219/702, 710, 704, 711

[56] References Cited

U.S. PATENT DOCUMENTS

| | | | |
|---|---|---|---|
| 3,670,134 | 6/1972 | Bucksbaum | 219/704 |
| 4,009,359 | 2/1977 | Tallmadge et al. | 219/705 |
| 4,584,448 | 4/1986 | Tanabe | 219/705 |
| 4,691,186 | 9/1987 | Shin et al. | 219/707 |
| 4,814,570 | 3/1989 | Takizaki | 219/10.55 B |
| 4,831,239 | 5/1989 | Ueda | 219/518 |

*Primary Examiner*—Philip H. Leung
*Attorney, Agent, or Firm*—Ostrolenk, Faber, Gerb & Soffen

[57] ABSTRACT

A method of preventing a no-load operation of a microwave oven. If a resistance of a gas sensor is greater than a first predetermined value, a cooking operation is normally performed. An initial signal value sensed by a temperature sensor is compared with a second predetermined value if the resistance of the gas sensor is smaller than or equal to the first predetermined value. If the initial signal value is greater than the second predetermined value, the initial signal value is compared with a signal value sensed by the temperature sensor after the lapse of a predetermined time period. If the initial signal value is greater than the sensed signal value, the cooking operation is normally performed. If the initial signal value is smaller than or equal to the sensed signal value, the present operation is discriminated as the no-load operation and the cooking operation is then stopped. A difference between the initial signal value and the sensed signal value is obtained if the initial signal value is smaller than or equal to the second predetermined value. The cooking operation is normally performed if the obtained value is smaller than or equal to a third predetermined value. If the obtained value is greater than the third predetermined value, the present operation is discriminated as the no-load operation.

3 Claims, 4 Drawing Sheets

METHOD OF PREVENTING NO-LOAD OPERATION OF MICROWAVE OVEN

BACKGROUND OF THE INVENTION

1. Field of the Invention

The present invention relates in general to the prevention of a no-load operation of a microwave oven, and more particularly to a method of preventing the no-load operation of the microwave oven in which the presence of a load or food in a heating chamber is discriminated according to a resistance variation of gas and temperature sensors which sense a variation in a gas amount and a temperature variation in the heating chamber, respectively, and, if the presence of no load in the heating chamber is discriminated, a heating operation is automatically stopped to prevent a damage due to heating under a no-load condition and an unnecessary power consumption.

2. Description of the Prior Art

Referring to FIG. 1, there is shown a schematic circuit diagram illustrating a construction of a conventional microwave oven. As shown in this drawing, the conventional microwave oven comprises a load driving circuit 2 connected in parallel between a primary coil of a high-voltage transformer (HVT) 1 and a power source to perform a cooking operation, a heater 3 for applying radiant heat to a heating chamber (not shown) in which a load or food is placed, a microwave generator 4 connected to a secondary coil of the high-voltage transformer 1 to generate a microwave, and a plurality of relays RY1–RY3 for turning on/off the high-voltage transformer 1, the heater 3 and the load driving circuit 2, respectively. The relay RY1 is a main relay for controlling the output of the microwave generator 4, the relay RY2 is a grille relay for controlling a temperature in the heating chamber and the relay RY3 is an auxiliary relay for controlling an oven lamp OL, a turntable motor TM and a fan motor FM in the load driving circuit 2.

Referring to FIG. 2, there is shown a schematic circuit diagram illustrating a circuit for controlling the operation of the conventional microwave oven. As shown in this drawing, the control circuit includes a microcomputer 6 for controlling the entire system operation, a gas sensor 7 for sensing a gas amount generated in the cooking operation, a temperature sensor 8 for sensing a temperature in the heating chamber, and a key input unit 5 for selecting a desired function according to a user's selection. The microcomputer 6 controls the relays RY1–RY3 in response to output signals from the gas and temperature sensors 7 and 8 to control the high-voltage transformer 1, the heater 3 and the load driving circuit 2.

The gas sensor 7 has one side for inputting a supply voltage Vcc and the other side connected to one side of a fixed resistor R, the other side of which is connected to a ground terminal. Also, the gas sensor 7 has a resistance varied with a variation in the gas amount. The supply voltage Vcc is divided by the varied resistance of the gas sensor 7 and a resistance of the fixed resistor R and then applied to the microcomputer 6. Similarly, the temperature sensor 8 has one side for inputting the supply voltage Vcc and the other side connected to one side of a fixed resistor R', the other side of which is connected to the ground terminal. Also, the temperature sensor 8 has a resistance varied with a variation in the temperature. The supply voltage Vcc is divided by the varied resistance of the temperature sensor 8 and a resistance of the fixed resistor R' and then applied to the microcomputer 6.

The operation of the conventional microwave oven with the above-mentioned construction will hereinafter be described with reference to FIGS. 3 to 5.

FIG. 3 is a flowchart illustrating a manual cooking operation of the conventional microwave oven. First, when a manual cooking function is selected by the key input unit 5 according to the user's selection, the microcomputer 6 turns on the main relay RY1 and the auxiliary relay RY3 according to the selected manual cooking function. As being turned on, the auxiliary relay RY3 drives the oven lamp OL, the turntable motor TM and the fan motor FM in the load driving circuit 2. As the main relay RY1 is turned on, the microwave generator 4 is driven by the high-voltage transformer 1, so as to apply the microwave to the heating chamber. As a result, the manual cooking operation of the microwave oven is advanced. Then, when a predetermined time period TA has elapsed, the manual cooking operation of the microwave oven is stopped regardless of the operation of the gas sensor 7.

FIG. 4 is a flowchart illustrating a grille automatic/manual cooking operation of the conventional microwave oven. First, in the case where a grille automatic/manual cooking function is selected by the key input unit 5 according to the user's selection, the microcomputer 6 turns on the auxiliary relay RY3 according to the selected grille automatic/manual cooking function. As being turned on, the auxiliary relay RY3 drives the oven lamp OL, the turntable motor TM and the fan motor FM in the load driving circuit 2. Then, the microcomputer 6 compares the present temperature C. sensed by the temperature sensor 8 with a predetermined value CA. If the present temperature C. sensed by the temperature sensor 8 is greater than the predetermined value CA as a result of the comparison, the microcomputer 6 determines that the temperature in the heating chamber is sufficiently high. As a result, the microcomputer 6 maintains the auxiliary relay RY3 at its ON state for a predetermined time period TB under the condition that it does not turn on the grille relay RY2. On the contrary, if the present temperature C sensed by the temperature sensor 8 is smaller than the predetermined value CA as a result of the comparison, the microcomputer 6 determines that the temperature in the heating chamber is not sufficiently high. As a result, the microcomputer 6 further turns on the grille relay RY2 to allow the heater 3 to apply the radiant heat to the heating chamber. Then, when the predetermined time period TA has elapsed, the grille automatic/manual cooking operation of the microwave oven is stopped.

FIG. 5 is a flowchart illustrating an automatic cooking operation of the conventional microwave oven. First, in the case where an automatic cooking function is selected by the key input unit 5 according to the user's selection, the microcomputer 6 turns on the auxiliary relay RY3 according to the selected automatic cooking function to drive the oven lamp OL, the turntable motor TM and the fan motor FM in the load driving circuit 2. Then, the microcomputer 6 maintains the auxiliary relay RY3 at its ON state for a predetermined time period (about 18 seconds) to discharge the remaining smell in the heating chamber of the microwave oven. When the predetermined time period has elapsed, the microcomputer 6 turns on the main relay RY1.

As the main relay RY1 is turned on, the microwave generator 4 is driven by the high-voltage transformer 1, so as to apply the microwave to the heating chamber. As a result, the automatic cooking operation of the microwave oven is advanced. The gas begins to be generated in the heating chamber as the automatic cooking operation of the microwave oven is advanced. The resistance Rs of the gas sensor 7 is reduced as the generated gas is increased in amount. At this time, a combined resistance ΔG (Ro/Rs) is increased, where Ro is the resistance of the fixed resistor R. Then, the microcomputer 6 is operated in such a manner that the microwave from the microwave generator 4 can be supplied to the heating chamber until the combined resistance ΔG reaches a predetermined value K. When the combined resistance ΔG reaches the predetermined value K, the heating operation is further performed for an additional heating time period TC and, then, the automatic cooking operation of the microwave oven is stopped.

However, the above-mentioned conventional microwave oven has a disadvantage in that the heating operation is continuously performed even upon the presence of no load or food in the heating chamber, resulting in a damage of the heating chamber and the associated components. Also, the continuous heating operation results in an unnecessary power consumption.

SUMMARY OF THE INVENTION

Therefore, the present invention has been made in view of the above problems, and it is an object of the present invention to provide a method of preventing a no-load operation of a microwave oven in which the presence of a load or food in a heating chamber is discriminated according to a resistance variation of gas and temperature sensors which sense a variation in a gas amount and a temperature variation in the heating chamber, respectively, and, if the presence of no load in the heating chamber is discriminated, a heating operation is automatically stopped to prevent a damage due to heating under a no-load condition and an unnecessary power consumption.

In accordance with the present invention, the above and other objects can be accomplished by a provision of a method of preventing a no-load operation of a microwave oven, comprising the steps of (a) comparing a resistance of gas sensing means varied with a variation in a gas amount with a first predetermined value after a cooking operation is performed for a predetermined time period and performing the cooking operation normally if the resistance of said gas sensing means is greater than the first predetermined value; (b) comparing an initial signal value sensed by temperature sensing means with a second predetermined value if the resistance of said gas sensing means is smaller than or equal to the first predetermined value as a result of the comparison at said step (a); (c) comparing the initial signal value sensed by said temperature sensing means with a signal value sensed by said temperature sensing means after the lapse of the predetermined time period if the initial signal value sensed by said temperature sensing means is greater than the second predetermined value as a result of the comparison at said step (b), performing the cooking operation normally if the initial signal value sensed by said temperature sensing means is greater than the signal value sensed by said temperature sensing means after the lapse of the predetermined time period, discriminating the present operation as the no-load operation if the initial signal value sensed by said temperature sensing means is smaller than or equal to the signal value sensed by said temperature sensing means after the lapse of the predetermined time period and then stopping the cooking operation; and (d) obtaining a difference between the initial signal value sensed by said temperature sensing means and the signal value sensed by said temperature sensing means after the lapse of the predetermined time period if the initial signal value sensed by said temperature sensing means is smaller than or equal to the second predetermined value as a result of the comparison at said step (b), comparing the obtained value with a third predetermined value, performing the cooking operation normally if the obtained value is smaller than or equal to the third predetermined value, discriminating the present operation as the no-load operation if the obtained value is greater than the third predetermined value and stopping the cooking operation.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
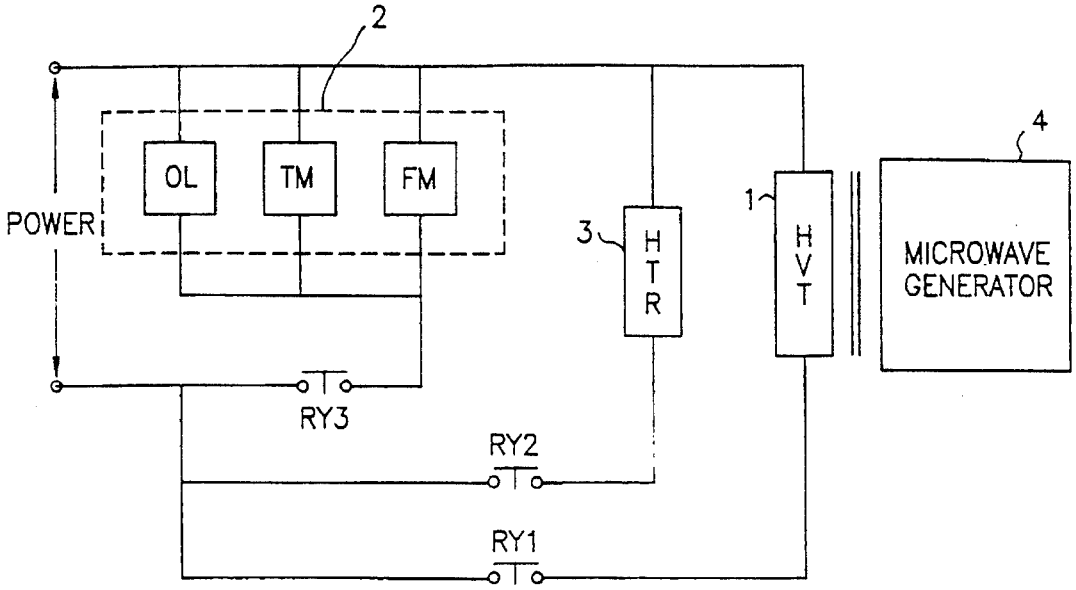
FIG. 1 CONVENTIONAL ART
FIG. 1 is a schematic circuit diagram illustrating a construction of a conventional microwave oven.
Figure 2:
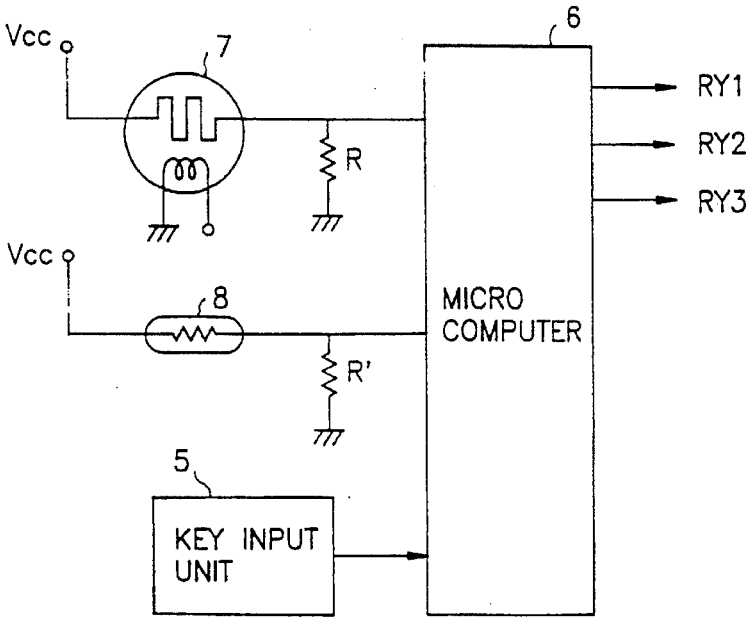
FIG. 2 CONVENTIONAL ART
FIG. 2 is a schematic circuit diagram illustrating a circuit for controlling an operation of the conventional microwave oven.
Figure 3:
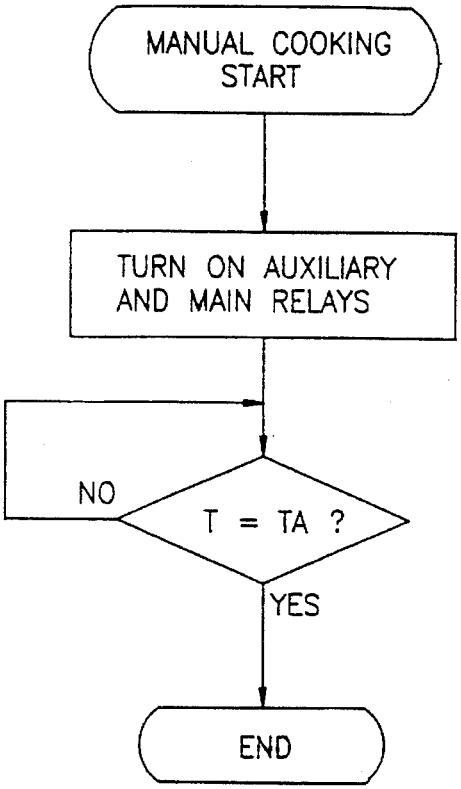
FIG. 3 CONVENTIONAL ART
FIG. 3 is a flowchart illustrating a manual cooking operation of the conventional microwave oven.
Figure 4:
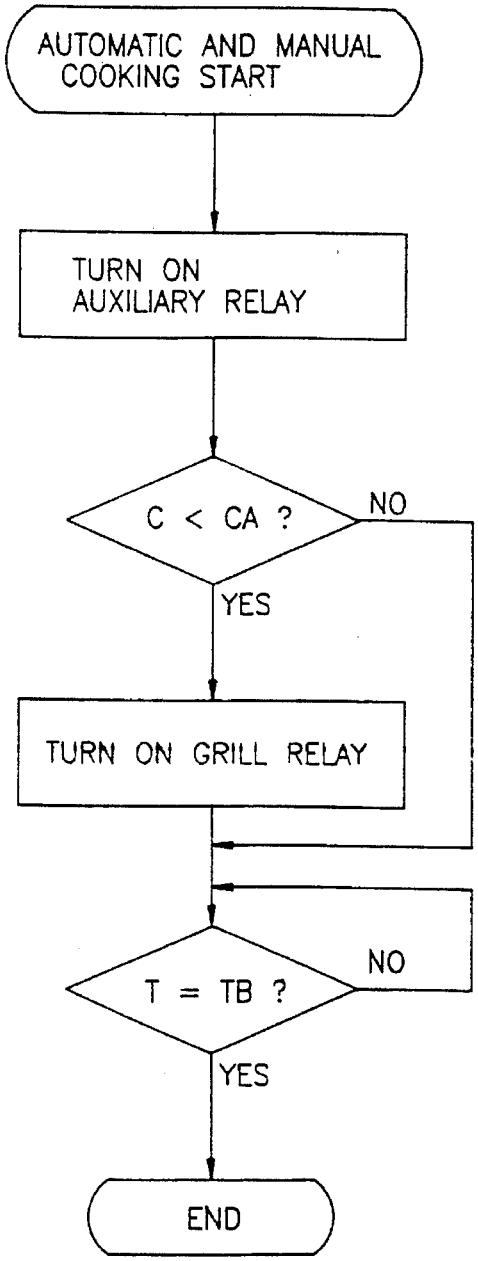
FIG. 4 CONVENTIONAL ART
FIG. 4 is a flowchart illustrating a grille automatic/manual cooking operation of the conventional microwave oven.
Figure 5:
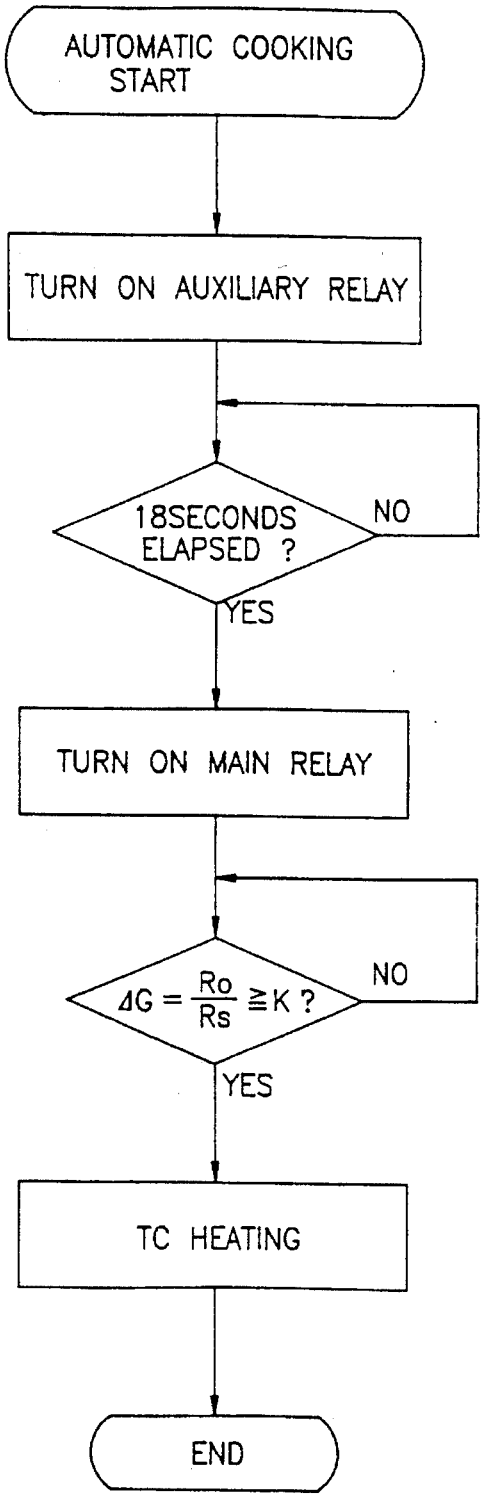
FIG. 5 CONVENTIONAL ART
FIG. 5 is a flowchart illustrating an automatic cooking operation of the conventional microwave oven.
Figure 6:
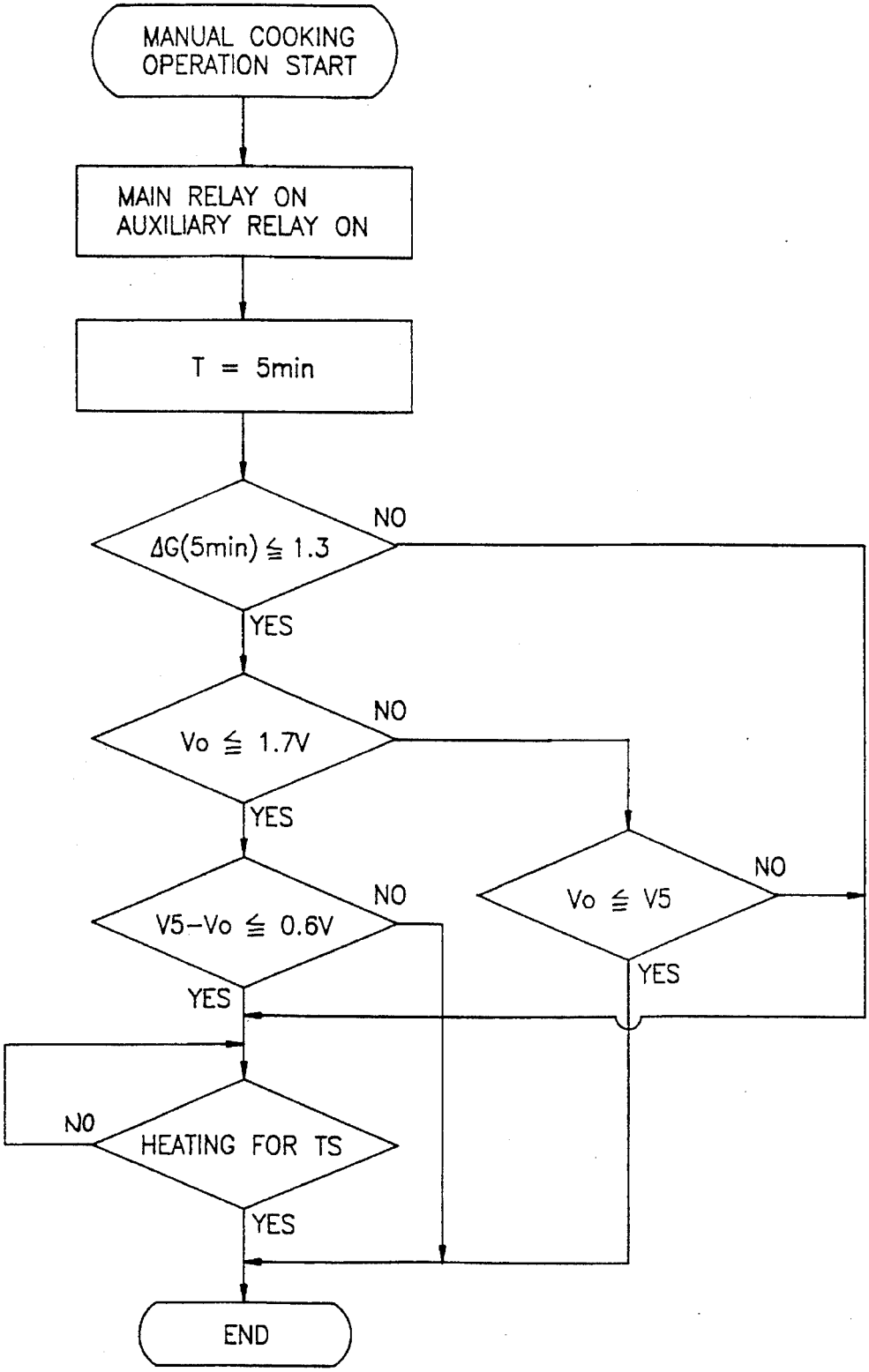
FIG. 6 is a flowchart illustrating a method of preventing a no-load operation of a microwave oven in accordance with the present invention.

Referring to FIG. 6, there is shown a flowchart illustrating a method of preventing a no-load operation of a microwave oven in accordance with the present invention. The no-load operation preventing method of the present invention will hereinafter be described in detail with reference to FIGS. 1 and 2 for illustrative purposes.

First, when the manual cooking function is selected by the key input unit 5 according to the user's selection, the microcomputer 6 turns on the main relay RY1 and the auxiliary relay RY3 according to the selected manual cooking function. As being turned on, the auxiliary relay RY3 drives the oven lamp OL, the turntable motor TM and the fan motor FM in the load driving circuit 2. As the main relay RY1 is turned on, the microwave generator 4 is driven by the high-voltage transformer 1, so as to apply the microwave to the heating chamber. As a result, the manual cooking operation of the microwave oven is advanced. Then, when five minutes have elapsed after the cooking is started, the microcomputer 6 calculates the combined resistance ΔG resulting from the gas sensor 7. If the calculated combined resistance ΔG is greater than 1.3, the microcomputer 6 determines that the load is present in the heating chamber. As a result, the heating operation is performed for a predetermined time period Ts and, then, the manual cooking operation of the microwave oven is stopped. Here, the resistance ΔG of 1.3 is a value which is experimentally set for discriminating the presence of the load in the heating chamber.

On the contrary, if the calculated combined resistance ΔG is smaller than or equal to 1.3, the microcomputer 6 discriminates whether an initial voltage Vo resulting from the temperature sensor 8 is greater than 1.7 V. If the initial voltage Vo resulting from the temperature sensor 8 is greater than 1.7 V, the microcomputer 6 compares the initial voltage Vo with a voltage V5 at a time point that five minutes have elapsed. When the initial voltage Vo is smaller than or equal to the voltage V5, the microcomputer 6 determines the presence of no load in the heating chamber and thus stops the manual cooking operation of the microwave oven. On the contrary, if the initial voltage Vo is greater than the voltage V5, the microcomputer 6 determines that the load is present in the heating chamber. As a result, the heating operation is performed for the predetermined time period Ts and, then, the manual cooking operation of the microwave oven is stopped. Noticeably, in the case where the load is present in the heating chamber, the temperature in the heating chamber is absorbed by the load or food for five minutes after the cooking is started. For this reason, the temperature at the moment that five minutes have elapsed becomes lower than that at the initial state. Here, the voltage of 1.7 V is a value obtained when a temperature sensed by the temperature sensor 8 is about 80° C.

On the other hand, if the initial voltage Vo resulting from the temperature sensor 8 is smaller than or equal to 1.7 V, a voltage (Vo–V5) is obtained by subtracting the voltage V5 from the initial voltage Vo and then compared with 0.6 V. When the obtained voltage (Vo–V5) is greater than 0.6 V, the microcomputer 6 determines the presence of no load in the heating chamber and thus stops the manual cooking operation of the microwave oven. On the contrary, if the obtained voltage (Vo–V5) is smaller than or equal to 0.6 V, the microcomputer 6 determines that the load is present in the heating chamber. As a result, the heating operation is performed for the predetermined time period Ts and, then, the manual cooking operation of the microwave oven is stopped. Here, the voltage of 0.6 V is a value obtained when a temperature variation sensed by the temperature sensor 8 is about 30° C. Noticeably, in the case where the load is present in the heating chamber, the temperature variation in the heating chamber does not exceed 30° C. for five minutes after the cooking is started.

As apparent from the above description, according to the present invention, the presence of the load or food in the heating chamber is discriminated according to the resistance variation of the gas and temperature sensors which sense the variation in the gas amount and the temperature variation in the heating chamber after the lapse of the predetermined time period from the initial operation of the microwave oven, respectively. If the presence of no load in the heating chamber is discriminated, the heating operation is automatically stopped. Therefore, the present invention can prevent a damage due to the heating under the no-load condition and an unnecessary power consumption. In result, the present invention has the effect of enhancing the reliability of the product and lengthening the life thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preventing a no-load operation of a microwave oven, comprising the steps of:

(a) comparing a resistance of gas sensing means varied with a variation in a gas amount with a first predetermined value after a cooking operation is performed for a predetermined time period and performing the cooking operation normally if the resistance of said gas sensing means is greater than the first predetermined value;

(b) comparing an initial signal value sensed by temperature sensing means with a second predetermined value if the resistance of said gas sensing means is smaller than or equal to the first predetermined value as a result of the comparison at said step (a);

(c) comparing the initial signal value sensed by said temperature sensing means with a signal value sensed by said temperature sensing means after the lapse of the predetermined time period if the initial signal value sensed by said temperature sensing means is greater than the second predetermined value as a result of the comparison at said step (b), performing the cooking operation normally if the initial signal value sensed by said temperature sensing means is greater than the signal value sensed by said temperature sensing means after the lapse of the predetermined time period, discriminating the present operation as the no-load operation if the initial signal value sensed by said temperature sensing means is smaller than or equal to the signal value sensed by said temperature sensing means after the lapse of the predetermined time period and then stopping the cooking operation; and (d) obtaining a difference between the initial signal value sensed by said temperature sensing means and the signal value sensed by said temperature sensing means after the lapse of the predetermined time period if the initial signal value sensed by said temperature sensing means is smaller than or equal to the second predetermined value as a result of the comparison at said step (b), comparing the obtained value with a third predetermined value, performing the cooking operation normally if the obtained value is smaller than or equal to the third predetermined value, discriminating the present operation as the no-load operation if the obtained value is greater than the third predetermined value and stopping the cooking operation.

2. A method of preventing a no-load operation of a microwave oven, as set forth in claim 1, wherein said second predetermined value is a voltage value obtained when a temperature sensed by said temperature sensing means is about 80° C.

3. A method of preventing a no-load operation of a microwave oven, as set forth in claim 1, wherein said third predetermined value is a voltage value obtained when a temperature variation sensed by said temperature sensing means is about 30° C.

* * * * *